US008265315B2

(12) United States Patent
Sørensen et al.

(10) Patent No.: US 8,265,315 B2
(45) Date of Patent: Sep. 11, 2012

(54) LISTENING SYSTEM COMPRISING A CHARGING STATION WITH A DATA MEMORY

(75) Inventors: Per Kokholm Sørensen, Smørum (DK); Frank Engel Rasmussen, Smørum (DK)

(73) Assignee: Oticon A/S, Smorum (DK)

( * ) Notice: Subject to any disclaimer, the term of this patent is extended or adjusted under 35 U.S.C. 154(b) by 515 days.

(21) Appl. No.: 12/577,566

(22) Filed: Oct. 12, 2009

(65) Prior Publication Data

US 2010/0098278 A1 Apr. 22, 2010

(30) Foreign Application Priority Data

Oct. 17, 2008 (DK) ..... 2008 00197 U

(51) Int. Cl.
*H04R 25/00* (2006.01)

(52) U.S. Cl. ..... 381/323; 381/314

(58) Field of Classification Search ..... 381/312, 381/314, 315, 322, 323, 23.1; 320/107, 114, 320/115

See application file for complete search history.

(56) References Cited

U.S. PATENT DOCUMENTS 5,197,332 A * 3/1993 Shennib ..... 73/585
7,283,639 B2 * 10/2007 Kariniemi ..... 381/312
7,430,299 B2 * 9/2008 Armstrong et al. ..... 381/312

* cited by examiner

*Primary Examiner* — Tuan Nguyen
(74) *Attorney, Agent, or Firm* — Buchanan Ingersoll & Rooney PC

(57) ABSTRACT

A listening system, e.g. a hearing aid system, including a charging station and one or more listening devices, e.g. hearing instruments. The hearing aid system includes a) a hearing instrument including a rechargeable battery for energizing the hearing instrument, and a volatile data memory, wherein basic data for the configuration of the hearing instrument are stored during normal operation, b) a charging station adapted for allowing a hearing instrument to be mounted and the battery to be recharged without removing the battery from the hearing instrument, and c) a connection allowing communication between the charging station and the hearing instrument, to allow the basic data for the configuration of the hearing instrument to be transferred from the data memory of the charging station to the data memory of the hearing instrument, when the hearing instrument is mounted in the charging station.

15 Claims, 2 Drawing Sheets

LISTENING SYSTEM COMPRISING A CHARGING STATION WITH A DATA MEMORY

CROSS-REFERENCE TO RELATED APPLICATIONS

The present application claims priority to Danish application BA 2008 00197 filed on 17 Oct. 2008.

TECHNICAL FIELD

The present disclosure relates to a listening system, e.g. a hearing aid system, comprising a charging station and one or more listening devices, e.g. hearing instruments. It further relates to a method of operating a listening device.

Embodiments of the disclosure can e.g. be used in connection with listening devices (e.g. hearing instruments) using rechargeable batteries as a source of energy. Embodiments of the disclosure are particularly useful in listening devices, e.g. hearing instruments, having special restrictions on available volume and/or power consumption, such as is the case e.g. in in-the-ear (ITE) type hearing instruments, such as completely-in-the-ear-canal (CIC) type hearing instruments, where all the normal functionality of the hearing instrument is contained in a device located in the ear canal of a user (e.g. including input and output transducers, signal processing unit and energy source).

BACKGROUND ART

The following account of the art relates to one of the areas of application of the disclosure, hearing instruments.

In hearing instruments using conventional batteries as energy source for the electronic components, there is a need for a non-volatile memory in order to keep relevant parameter settings in the hearing instrument during battery changes. In a hearing instrument comprising one or more rechargeable batteries, where the battery(-ies) does/do not necessarily have to be removed from the hearing instrument during charging of the battery(ies), the relevant parameter settings can in some cases be retained, even when battery voltage is too low for the hearing aid to be fully functional. The same applies to data logging information, which can be exchanged with the charging station during recharging of the battery(-ies) of the hearing instrument.

OBJECTS AND SUMMARY

The present disclosure relates to a system comprising a hearing instrument comprising a rechargeable energy source and a charging station for recharging the rechargeable energy source, a memory for storing the basic data of the hearing instrument (i.e. the data that are necessary for the hearing instrument to work properly, such as identification data, configuration data, program data, etc.). Preferably, the memory of the hearing instrument is a volatile memory that loses its contents when the supply voltage is below a threshold value. The charging station contains a memory for storing the basic data of the hearing instrument. The memory of the charging station is preferably a non-volatile memory, e.g. in the form of a fixed memory built into the charging station or a memory stick or memory card or other movable memory. Alternatively, it can be a volatile memory that is always sufficiently powered to keep its contents and/or can be loaded with the appropriate data, e.g. via a network connection to a server, when needed. The system is adapted to transfer the basic data of the hearing instrument to a (e.g. volatile) memory of the hearing instrument, while the hearing instrument is mounted in or near the charging station. The charging station may be connected to the internet (e.g. via a USB connection and a computer). This would allow the user, dispenser or manufacturer to analyze the data from the hearing instrument and/or to upload basic data of the hearing instruments and/or software updates (e.g. firmware updates) to the hearing instrument. The inventive hearing instrument is potentially cheaper to manufacture and smaller in size since, there is no need for a non-volatile memory in the hearing instrument.

An object of the disclsoure is to provide an alternative scheme of operating a hearing instrument comprising a rechargeable energy source.

The disclosure relates to a hearing aid system comprising:

a) a hearing instrument comprising a rechargeable battery for energizing the hearing instrument, and a volatile data memory, wherein basic data for the configuration of the hearing instrument are stored during normal operation;

b) a charging station adapted for allowing a hearing instrument to be mounted and the battery to be recharged without removing the battery from the hearing instrument, wherein the charging station comprises a data memory, wherein the basic data for the configuration of the hearing instrument can be stored; and c) a connection allowing communication between the charging station and the hearing instrument, to allow the basic data for the configuration of the hearing instrument to be transferred from the data memory of the charging station to the data memory of the hearing instrument, when the hearing instrument is mounted in the charging station.

An advantage of the disclosure is that a non-volatile memory can be dispensed with in the hearing instrument, thereby allowing a smaller and cheaper and more energy efficient hearing instrument to be made.

In an embodiment, the hearing instrument comprises an input transducer for picking up an input sound in the environment and converting it to an electric input signal and an output transducer for converting an electric output signal to an output sound adapted for being presented to a user wearing the hearing instrument.

In an embodiment, the hearing instrument comprises a signal processor electrically connected to the input and output transducers and adapted to perform signal processing on the electric input signal using at least some of the basic data for the configuration of the hearing instrument read from the volatile memory of the hearing instrument. In an embodiment, at least some of the basic data for the configuration of the hearing instrument are used by the signal processor to provide a frequency dependent gain, e.g. adapted to a user's hearing impairment.

In an embodiment, the hearing aid system is adapted to be able to monitor the battery voltage of the hearing instrument. The monitoring unit can e.g. be located in the hearing instrument and the status be registered by a signal processor in the hearing instrument. Alternatively, the monitoring unit can be located in the charging station, so that the battery voltage of the hearing instrument can be monitored when it is placed in the charging station.

In an embodiment, the hearing aid system is adapted to provide that the basic data for the configuration of the hearing instrument are stored in the data memory of the charging station. This can preferably be done initially during fitting of the hearing instrument to the user's needs. The relevant data can e.g. be downloaded to the charging station from a PC, e.g. from the PC that is used to fit the hearing instrument or the data can be stored on a movable storage medium or sent to the user (either to a PC or the user with an e-mail and subsequently copied to a movable storage medium, or directly to the charging station, in case it is connectable to a network, e.g. the Internet).

In an embodiment the hearing aid system is adapted to transfer data from the hearing instrument to the data memory of the charging station. Such data can e.g. include the basic data for the configuration of the hearing instrument. Alternatively, such data can include other data, e.g. related to a hearing instrument status and/or operation, e.g. a form of log of the user's inputs (e.g. preferred programs, volume settings, etc.) or data concerning the acoustic environments, which the hearing instrument has encountered, or data concerning the battery status, e.g. its current voltage or an estimate of the remaining time of operation, etc.

In an embodiment, the data memory of the charging station is a non-volatile data memory. The non-volatile data memory of the charging station can e.g. include a movable storage medium, e.g. a memory stick, or a hard disk (e.g. a CD-ROM or DVD), or a flash memory.

In an embodiment, the hearing aid system is adapted to be (wired or wirelessly) connectable to a computer and/or a server, e.g. via a network, e.g. the Internet. In an embodiment, the charging station comprises a transceiver for establishing a wireless link to another device, e.g. a Bluetooth transceiver. This allows an analysis of data related to the hearing instrument to be performed at any physical location, e.g. by the manufacturer and/or at specialist in adapting hearing instruments to the needs of a user (e.g. an audiologist). Conversely it allows data to be uploaded from a server to the charging station and further to the hearing instrument. Examples of such data can be: 1. Basic data of the hearing instrument; 2. Modifications to the basic data of the hearing instrument; 3. Updates to the software or firmware of the hearing instrument, etc. In an embodiment, the system is adapted to provide that a connection to a server is established (either automatically or possibly initiated by the user) to check for updates to the hearing instrument basic data and/or software/firmware, when the hearing instrument is mounted in the charging station.

In an embodiment, the charging station comprises one or more USB-connectors, e.g. to establish connection to other units, including a (USB-) memory stick or to a cell phone or a PC (e.g. via an USB dongle crating a wireless connection to another unit), e.g. via Bluetooth.

In an embodiment, the hearing aid system is adapted to provide that data transfer between the charging station and the hearing instrument is initiated automatically, when the hearing instrument is mounted in the charging station (e.g. electrically connected to the charging station). In an embodiment, the hearing aid system is adapted to transfer the basic data for the configuration of the hearing instrument from the data memory of the charging station to the volatile data memory of the hearing instrument, when the battery voltage of the hearing instrument is above a predefined threshold voltage, for which the hearing instrument is functionally operational.

In an embodiment, the system is adapted to provide that the connection allowing communication between the hearing instrument and the charging station is wireless, e.g. based on inductive communication between charging station and hearing instrument. In an embodiment, the connection is two-way. In an embodiment, the connection is one-way from the charging station to the hearing instrument. In an embodiment, the hearing instrument and the charging station each comprises respective transceivers to allow such wireless connection. This has the advantage of avoiding the electrical contacts to be established, which provides a more flexible mounting procedure.

In an embodiment, the hearing aid system is adapted to provide that the connection allowing communication between the hearing instrument and the charging station is a wired connection that is established via galvanic contact between the hearing instrument and the charging station when the hearing instrument is mounted in the charging station. This has the advantage of avoiding the necessity of wireless transceiver circuitry, which especially in the hearing instrument is of interest to minimize volume and power consumption.

In an embodiment the charging of a battery of the hearing instrument is performed via a wireless connection, e.g. inductively or capacitively. In an embodiment the charging of a battery of the hearing instrument is performed via a wired connection that is established via galvanic contact between the hearing instrument and the charging station when the hearing instrument is mounted in the charging station. This has the advantage of avoiding the necessity of wireless energizing circuitry, which especially in the hearing instrument is of interest to minimize volume and power consumption.

In an embodiment, the charging station is adapted to be able to receive at least two hearing instruments and to recharge both (or all) simultaneously. This can e.g. be achieved by doubling some necessary functions, e.g. the data memory of the charging station should be adapted to store basic data of both of the hearing instruments (if these are different for the two instruments). Likewise, the necessary contacts between charging station and hearing instruments (to allow charging and data exchange) should be arranged.

Preferably, the hearing instrument and/or the rechargeable battery is/are adapted to provide fully functional operation for a predefined period of time. In an embodiment, the predefined period of time is larger than one hour, preferably larger than two hours, such as larger than 4 hours, preferably larger than 8 hours, such as larger than 12 hours, preferably larger than 16 hours. Preferably, the predefined period of time is larger than a normal period of use of the hearing instrument for a particular user, so that he or she can conveniently mount the hearing instrument(s) in the charging station for recharge, when the hearing instrument-function is no longer in needed (e.g. during sleep or other activity, where the instruments are not used). In case the predefined period of time is shorter than a normal period of use for a particular user, the user could have two or more sets of instruments, one set being recharged while the other is being used. Preferably, the system is adapted to provide that a normal recharging time of the rechargeable batteries is shorter than the time of fully functional operation of a hearing instrument with a fully charged battery.

In an embodiment, the hearing instrument is adapted to provide that the power source can not be fully disconnected by a user to ensure that the basic data of the hearing instrument are not un-intentionally lost during a normal period of operation. In an embodiment, the hearing instrument is adapted to provide that a switch between a normal mode of operation and a low power mode can be initiated. In the low power mode the volatile memory is powered sufficiently to ensure that the basic data of the hearing instrument are not erased (and can be read by a processing unit, when returning to a normal mode), while other functions of the hearing instrument are limited or switched off to save power.

In an embodiment, the hearing instrument is adapted to provide that the rechargeable battery is NOT exchangeable by the user. In an embodiment, the hearing instrument is intended to be brought to a technical facility to have its battery exchanged. In an embodiment, the hearing instrument is adapted to be dispensed with, when the rechargeable battery is worn out, e.g. due to too many charging cycles. The present system has the advantage that—when the basic data of the hearing instrument are stored in the charging station (or possibly can be re-loaded from a server)—a new un-fitted (uncustomized) instrument (e.g. sent to the user from a dispenser or a manufacturer) is automatically adapted to the user's needs when located in the charging station for re-charging.

A method of operating a hearing instrument comprising a rechargeable battery for energizing the hearing instrument and a volatile data memory, wherein basic data for the configuration of the hearing instrument can be stored is furthermore provided. The method comprises:

a) storing basic data for the configuration of the hearing instrument in a data memory of a charging station adapted for allowing a hearing instrument to be mounted and the battery to be recharged without removing the battery from the hearing instrument;
b) mounting the hearing instrument in the charging station allowing a recharging of the rechargeable battery of the hearing instrument and the transfer of data from the charging station to the hearing instrument;
c) initiating the recharging of the rechargeable battery of the hearing instrument; and
d) transferring basic data for the configuration of the hearing instrument from the memory of a charging station to the volatile memory of the hearing instrument.

It is intended that the structural features of the system described above, in the detailed description of preferred embodiments and in the claims can be combined with the method, when appropriately substituted by a corresponding process. Embodiments of the method have the same advantages as the corresponding systems.

In an embodiment, the method comprises providing that a first hearing instrument is exchanged with another identical hearing instrument, when the rechargeable battery is de-charged or worn out.

Further objects of the disclosure are achieved by the embodiments defined in the dependent claims and in the detailed description of preferred embodiments.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements maybe present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF DRAWINGS

The disclosure will be explained more fully below in connection with a preferred embodiment and with reference to the drawings in which.

The figures are schematic and simplified for clarity, and they just show details which are essential to the understanding of embodiments of the disclosure, while other details are left out. Throughout, the same reference numerals are used for identical or corresponding parts.

Further scope of applicability of the present disclosure will become apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from this detailed description.

DETAILED DESCRIPTION OF PREFERRED EMBODIMENTS

Figure 1:
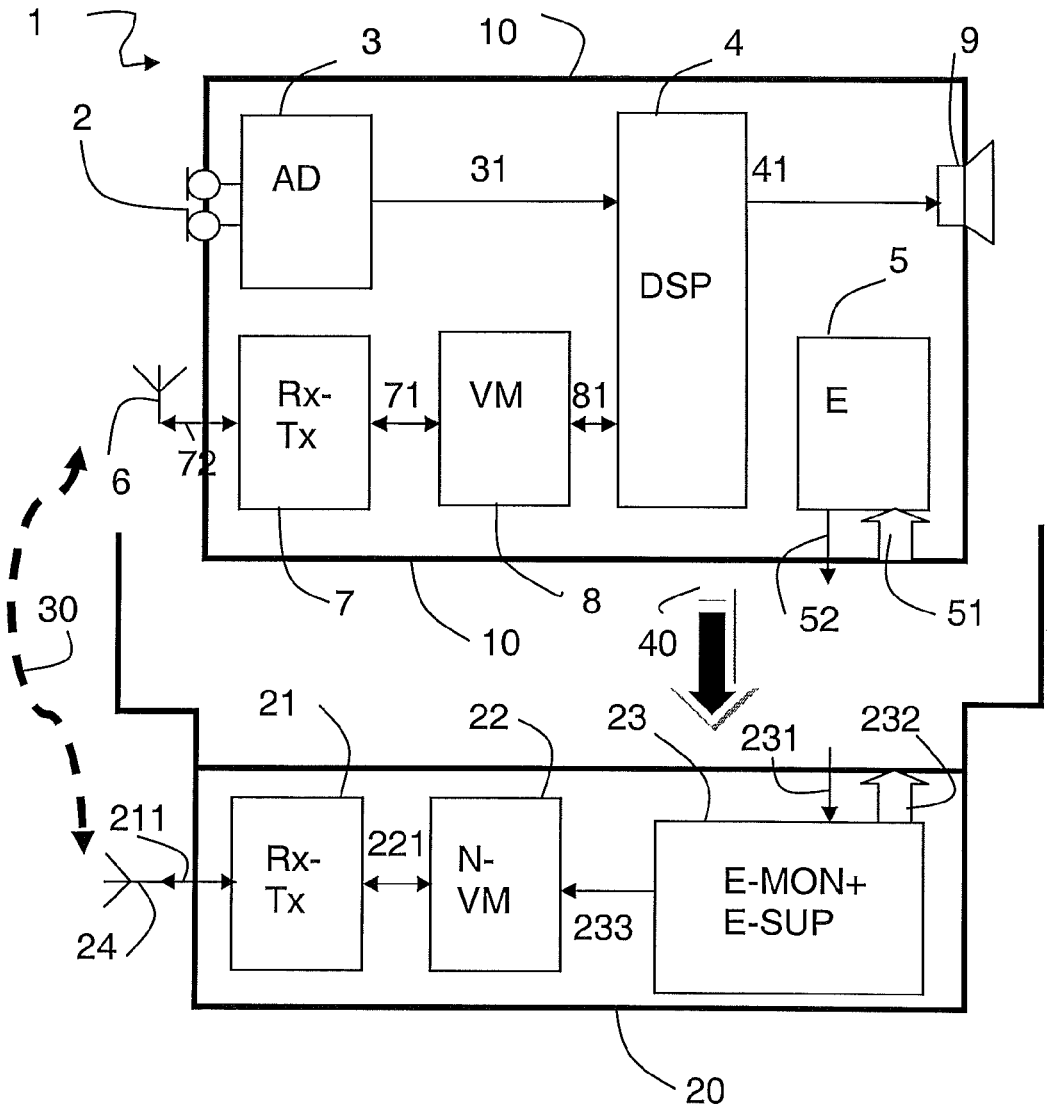
FIG. 1 shows a first embodiment of a hearing aid system comprising a hearing instrument and a charging station for recharging a rechargeable battery of the hearing instrument.

FIG. 1 shows a first embodiment of a hearing aid system 1 comprising a hearing instrument 10 and a charging station 20 for recharging a rechargeable battery of the hearing instrument. The functional blocks enclosed by the bold rectangle 10 constitute the hearing instrument (together with possible additional—not shown—functional blocks (including e.g. feedback compensation)). Similarly, the functional blocks enclosed by the bold frame 20 (together with possible additional—not shown—functional blocks) constitute a charging station for recharging rechargeable batteries 5 in one or more hearing instruments 10 and for exchanging data with the hearing instruments. The two-way dashed arrow 30 symbolizes a two-way wireless connection between the charging station 20 and the hearing instrument(s) 10. The wireless connection can alternatively be one-way (from charging station to hearing instrument) and can possibly be wired (cf. FIG. 2). The black arrow 40 symbolizes a mounting of the listening instrument 10 in the charging station 20. The system is arranged to provide that communication between charging station and hearing instrument can be established via connection 30, when the hearing instrument is placed in the charging station. In this situation, data can be exchanged between the charging station and the hearing instrument (including transferring the basic data for the function of the hearing instrument from the data memory of the charging station to the data memory of the hearing instrument). Simultaneously, or preferably before the data transfer (to ensure a proper voltage level of the hearing instrument to be able to receive, store and keep the transferred data in the memory), recharging of the rechargeable battery of the hearing instrument can commence, when electrical contact between the hearing instrument and the charging station has been established. In an embodiment, data exchange is not commenced until a predefined threshold voltage on the rechargeable battery has been reached. Alternatively, data exchange is not commenced until a predefined recharging time has elapsed, e.g. at least ½ or 1 hour, such as at least 2 hours.

FIG. 1 shows (selected parts of) an embodiment of a hearing instrument 10 for use in the present disclosure. The hearing instrument 10 comprises a microphone unit 2 (e.g., as here, a pair of (e.g. directional) microphones), an AD-converter 3 (possibly comprising a directional extraction system), that provides a first digital audio signal 31 to a signal processor 4 (DSP), which provides the for a user necessary modification of the signal (e.g. a frequency dependent gain), before the modified signal 41 is fed to the speaker 9 (the 'receiver') of the hearing instrument. The hearing instrument comprises a rechargeable battery 5 (E), which provides the electric components of the hearing instrument with energy. The rechargeable battery can be recharged via connection 51 (e.g. a connector (e.g. of the plug and socket type) or a pair of electric contacts) and the status of the battery can be read and e.g. transferred or measured via the signal or the connection 52. The hearing instrument additionally comprises a volatile data memory 8 (VM), wherein basic data for the configuration of the hearing instrument are stored during normal operation of the hearing instrument. The data memory 8 can exchange data with the signal processor 4 via signal 81. Additionally, the hearing instrument comprises a transceiver 6, 7 (here shown to comprise an en antenna part 6 and a signal processing part 7 (Rx-Tx)) of a wireless signal 30 (e.g. RF (far-field), IR, inductive (near-field), etc.). The data memory 8 can additionally exchange data with the transceiver 6, 7, (and thus with the charging station 20 via the wireless connection 30) via signals 71 and 72. In the shown embodiment, the hearing instrument does not comprise any non-volatile memory, whereby space and current (power) can be saved.

The charging station 20 comprises a data memory 22 (N-VM), wherein the basic data for the configuration of the hearing instrument are stored. In the embodiment shown, the data memory 22 is a NON-volatile data memory, e.g. a movable data memory, e.g. a flash memory or a (e.g. USB-) memory stick. Additionally, the charging station comprises a transceiver 24, 21 (here shown to comprise an antenna part 24 and a signal processing part 21 (Rx-Tx)) for receiving and transmitting a wireless signal 30 (e.g. RF, IR, inductive, etc.) to the establishment of a wireless connection 30 between the charging station 20 and the hearing instrument 10 vi the corresponding transceiver 6, 7 in the hearing instrument. The communication link 30 between the charging station and the hearing instrument is adapted to provide that the basic data for the configuration of the listening instrument can be transferred from the data memory of the charging station to the data memory of the hearing instrument, when the hearing instrument is mounted in the charging station. The link can additionally be used to transfer data from the hearing instrument to the charging station, e.g. data concerning the use or operation of the hearing instrument. Additionally, the charging station comprises a source of electric energy 23, e.g. a battery or a voltage transformer connected to the main electric power supply (e.g. 220 V AC), for the charging or recharging of the battery 5 of the hearing instrument, via connection 232, which is electrically connected to the connection 51 in the hearing instrument (e.g. either via a connector or any other electric connection), when the hearing instrument is placed in the charging station. Status for battery 5 of the hearing instrument can e.g. be read via connection 231-52 between the charging station and the hearing instrument, and be monitored in the charging station by the monitoring and charging unit 23 (E-MON+FE-SUP). Status for battery 5 of the hearing instrument can alternatively be transferred via communication link 30. The data memory 22 can e.g. exchange data with the monitoring and charging unit 23 via signal 233. The basic data for the configuration of the hearing instrument are stored in the data memory 22. These data can e.g. be stored during fitting of the hearing instrument by a specialist in fitting of hearing instruments, e.g. via a PC-interface (or stored directly on the, possibly movable, NON-volatile data memory, e.g. a memory stick). Alternatively, the charging station can comprise a network interface, so that the basic data for the configuration of the hearing instrument can be retrieved from a database, the data of the database e.g. having been created by the specialist having fitted the hearing instrument in question to the needs of the user in question. The data memory 22 can additionally exchange data with the transceiver 24, 21, (and thus with the hearing instrument 10 via the wireless connection 30) via signals 221 and 211, so that among other data the basic data for the configuration of the hearing instrument can be transferred. In a particular embodiment, the system is adapted to transfer data from charging station to hearing instrument depending on the status of the battery of the hearing instrument, e.g. when the current battery voltage exceeds a predetermined lower threshold value for the battery voltage.

The wireless signal 30 can e.g. be an inductive signal (based on two electric coils that are coupled inductively with each other) or an electromagnetic RF-signal, e.g. based on a communications standard, e.g. BlueTooth or be an optical signal (e.g. comprising or constituted by infrared light). In the latter case, the shown transceivers of the hearing instrument and the charging station comprise a photo detector instead of (or in addition to) an antenna.

Figure 2:
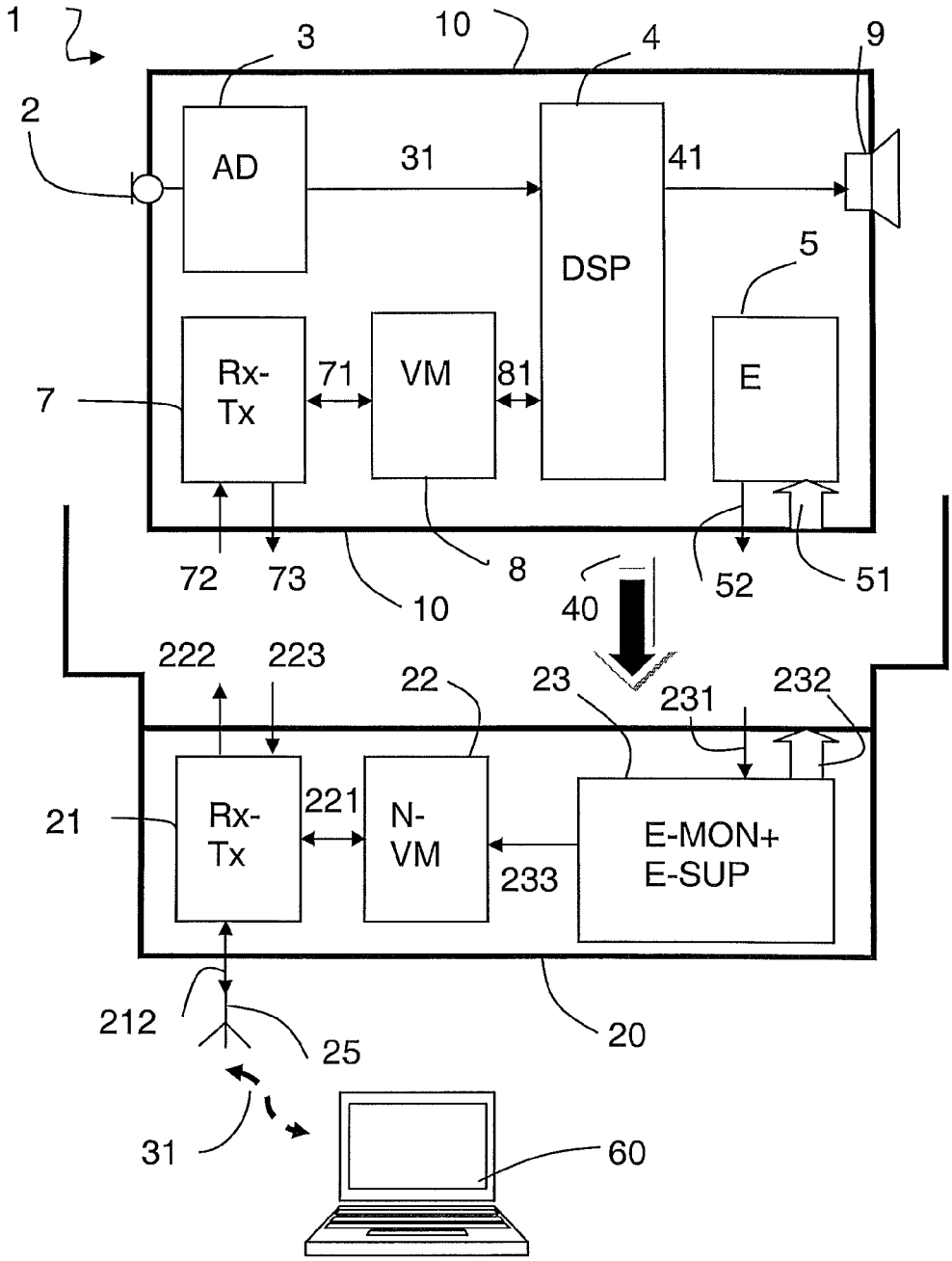
FIG. 2 shows a second embodiment of a hearing aid system comprising a hearing instrument and a charging station for recharging a rechargeable battery of the hearing instrument, the charging station comprising a link to a server or PC.

FIG. 2 shows a second embodiment of a hearing aid system comprising a hearing instrument and a charging station for recharging a rechargeable battery of the hearing instrument, the charging station comprising a link to a server or PC. The embodiment of the system shown in FIG. 2 has largely the same features as the embodiment of FIG. 1. Only the differences are described in the following. Instead of a wireless communication link between the charging station and the hearing instrument as shown in FIG. 1 (dotted arrow 30 and corresponding transceiver circuitry), the connection between the charging station and the hearing instrument is a wired connection 72, 222, 73, 223 in the embodiment of FIG. 2. The wired connection is e.g. established via corresponding electrical connectors (e.g. of the plug and socket type) or corresponding galvanic contacts 72, 73 and 222, 223 on the charging station and the hearing instrument, respectively, which are brought into electrical contact when the hearing instrument is properly mounted in the charging station. The electrical signals exchanged between the hearing instrument and the charging station are driven by electrical circuitry 7 (Rx-Tx) and 21 (Rx-Tx) of the hearing instrument and charging station, respectively. Further, a connection to a PC (here shown as a wireless connection 31, e.g. using Bluetooth), e.g. for establishing connection between the charging station and a database comprising data relevant for the hearing instrument (e.g. basic data of the hearing instrument or software/firmware) and/or the rechargeable battery (e.g. charging algorithms, etc.). Such data which may be transferred from the PC to the charging station and stored in the data memory of the charging station (and which may be transferred in full or partially to the hearing instrument) may reside on the PC 60 or on a server accessible by the PC via a network. The wireless connection 31 is established via transceiver 21 (Rx-Tx), connection 212 and antenna 25 of the charging station and corresponding circuitry in the PC 60. The Rx-Tx circuitry 21 of the charging station includes both the transceiver functionality of the wireless link 31 to the PC as well as the drivers for the wired connection 72, 222, 73, 223 to the hearing instrument. Further, the microphone unit 2 contains only one microphone in the embodiment of FIG. 2.

An embodiment of the disclosure is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims.

The invention claimed is:

1. A hearing aid system comprising:

a) a hearing instrument comprising a rechargeable battery for energizing the hearing instrument, and b) a charging station, adapted for allowing a hearing instrument to be mounted and the battery to be recharged without removing the battery from the hearing instrument, wherein the hearing instrument further comprises a volatile data memory, wherein basic data for the configuration of the hearing instrument are stored during normal operation, and wherein the charging station comprises a data memory, wherein the basic data for the configuration of the hearing instrument can be stored, and wherein the system further comprises:

c) a connection allowing communication between the charging station and the hearing instrument, to allow the basic data for the configuration of the hearing instrument to be transferred from the data memory of the charging station to the data memory of the hearing instrument, when the hearing instrument is mounted in the charging station.

2. A hearing aid system according to claim 1 adapted to be able to monitor the battery voltage of the hearing instrument.

3. A hearing aid system according to claim 1 adapted to transfer data from the hearing instrument to the data memory of the charging station.

4. A hearing aid system according to claim 1, wherein the data memory of the charging station is a non-volatile data memory.

5. A hearing aid system according to claim 1 adapted to be connectable to a computer and/or a server.

6. A hearing aid system according to claim 5 adapted to provide that data can be uploaded from a server to the charging station and further to the hearing instrument.

7. A hearing aid system according to claim 1, wherein the charging station comprises one or more USB-connectors.

8. A hearing aid system according to claim 1 adapted to provide that data transfer between the charging station and the hearing instrument is initiated automatically, when the hearing instrument is mounted in the charging station.

9. A hearing aid system according to claim 1 adapted to transfer the basic data for the configuration of the hearing instrument from the data memory of the charging station to the volatile data memory of the hearing instrument, when the battery voltage of the hearing instrument is above a predefined threshold voltage, for which the hearing instrument is functionally operational.

10. A hearing aid system according to claim 1 adapted to provide that the connection allowing communication between the hearing instrument and the charging station is wireless.

11. A hearing aid system according to claim 1 adapted to provide that the connection allowing communication between the hearing instrument and the charging station is a wired connection that is established via galvanic contact between the hearing instrument and the charging station when the hearing instrument is mounted in the charging station.

12. A hearing aid system according to claim 1 adapted to provide that the charging of a battery of the hearing instrument is performed via a wired connection that is established via galvanic contact between the hearing instrument and the charging station when the hearing instrument is mounted in the charging station.

13. A hearing aid system according to claim 1 adapted to provide fully functional operation for a predefined period of time larger than one hour.

14. A method of operating a hearing instrument comprising a rechargeable battery for energizing the hearing instrument and a volatile data memory, wherein basic data for the configuration of the hearing instrument can be stored, the method comprising:

a) storing basic data for the configuration of the hearing instrument in a data memory of a charging station adapted for allowing a hearing instrument to be mounted and the battery to be recharged without removing the battery from the hearing instrument;

b) mounting the hearing instrument in the charging station allowing a recharging of the rechargeable battery of the hearing instrument and the transfer of data from the charging station to the hearing instrument;

c) initiating the recharging of the rechargeable battery of the hearing instrument; and d) transferring basic data for the configuration of the hearing instrument from the memory of a charging station to the volatile memory of the hearing instrument.

15. A method according to claim 14 comprising providing that a first hearing instrument is exchanged with another identical hearing instrument, when the rechargeable battery is de-charged or worn out.

* * * * *